US010638239B2

(12) United States Patent
Kamkar-Parsi et al.

(10) Patent No.: US 10,638,239 B2
(45) Date of Patent: Apr. 28, 2020

(54) METHOD OF OPERATING A HEARING AID, AND HEARING AID

(71) Applicant: SIVANTOS PTE. LTD., Singapore (SG)

(72) Inventors: Homayoun Kamkar-Parsi, Erlangen (DE); Marko Lugger, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 118 days.

(21) Appl. No.: 15/842,145

(22) Filed: Dec. 14, 2017

(65) Prior Publication Data

US 2018/0176697 A1 Jun. 21, 2018

(30) Foreign Application Priority Data

Dec. 15, 2016 (DE) ..... 10 2016 225 207

(51) Int. Cl.
*H04R 25/00* (2006.01)

(52) U.S. Cl.
CPC ..... *H04R 25/505* (2013.01); *H04R 25/407* (2013.01); *H04R 25/552* (2013.01); *H04R 25/70* (2013.01); *H04R 25/30* (2013.01); *H04R 25/60* (2013.01); *H04R 2225/43* (2013.01)

(58) Field of Classification Search
CPC combination set(s) only.
See application file for complete search history.

(56) References Cited

U.S. PATENT DOCUMENTS 6,947,570 B2 9/2005 Maisano
6,950,528 B2 * 9/2005 Fischer ..... H04R 3/005 381/91
7,076,069 B2 7/2006 Roeck
8,238,593 B2 * 8/2012 Bisgaard ..... H04R 3/005 381/312
8,325,957 B2 12/2012 Fischer et al.
2010/0303267 A1 * 12/2010 Pedersen ..... H04R 25/407 381/313
2011/0170705 A1 * 7/2011 Kanamori ..... H04R 3/005 381/92

(Continued)

FOREIGN PATENT DOCUMENTS

DE 102013215131 A1 2/2015
EP 2036396 A1 3/2009

(Continued)

*Primary Examiner* — Fan S Tsang
*Assistant Examiner* — Angelica M McKinney
(74) *Attorney, Agent, or Firm* — Laurence A. Greenberg; Werner H. Stemer; Ralph E. Locher

(57) ABSTRACT

A hearing aid has a first input transducer that generates a first input signal from an ambient sound signal, a second input transducer that generates a second input signal from the sound signal and at least one output transducer. A first direction is assigned to a first useful signal source and a second direction is assigned to a second useful signal source, which is spatially separated from the first useful signal source. Based on the first input signal and the second input signal, a first reference signal oriented in the first direction and a second reference signal oriented in the second direction are formed. An output signal is formed on the basis of the first reference signal and the second reference signal, and the output signal is converted into a sound signal by the output transducer of the hearing aid.

12 Claims, 3 Drawing Sheets

(56) References Cited

U.S. PATENT DOCUMENTS

| | | | | |
|---|---|---|---|---|
| 2012/0020503 | A1 | 1/2012 | Endo et al. | |
| 2013/0044894 | A1* | 2/2013 | Samsudin | H04R 3/005 381/92 |
| 2013/0144622 | A1 | 6/2013 | Yamada et al. | |
| 2015/0036850 | A1 | 2/2015 | Barthel | |
| 2015/0156592 | A1 | 6/2015 | Jensen | |
| 2017/0295437 | A1* | 10/2017 | Bertelsen | H04R 25/353 |
| 2018/0103327 | A1* | 4/2018 | Mosgaard | H04M 1/72591 |
| 2018/0176697 | A1* | 6/2018 | Kamkar-Parsi | H04R 25/505 |
| 2019/0075405 | A1* | 3/2019 | Fischer | H04R 25/405 |

FOREIGN PATENT DOCUMENTS

| | | | |
|---|---|---|---|
| EP | 2658289 | A1 | 10/2013 |
| EP | 2876900 | A1 | 5/2015 |
| JP | WO2009025090 | A1 | 11/2010 |
| JP | 2013236396 | A | 11/2013 |
| JP | WO2012042768 | A1 | 2/2014 |
| WO | 2007147418 | A1 | 12/2007 |
| WO | 2008043758 | A1 | 4/2008 |

* cited by examiner

METHOD OF OPERATING A HEARING AID, AND HEARING AID

CROSS-REFERENCE TO RELATED APPLICATION

This application claims the benefit, under 35 U.S.C. § 119, of German patent application DE 10 2016 225 207.0, filed Dec. 15, 2016; the prior application is herewith incorporated by reference in its entirety.

BACKGROUND OF THE INVENTION

Field of the Invention

The invention pertains to a method of operating a hearing aid. The hearing aid comprises at least one first input transducer, a second input transducer and at least one output transducer. The first input transducer generates a first input signal from an ambient sound signal and the second input transducer generates a second input signal from the sound signal. An output signal is formed on the basis of a number of signals, which are derived from the first input signal and the second input signal. The output signal is converted into a sound signal at least by the output transducer of the hearing aid.

The handling of conversational situations is one of the core problems in the application of hearing aids. This is due mainly to the fact that the user of a hearing aid often receives important information in a personal conversation. Purely from the point of view of the most reliable transfer of information possible, it is therefore appropriate to attach particular importance to the intelligibility of speech for the user of a hearing aid. On the other hand, it is precisely speech intelligibility that is often adversely affected by the fact that typical speech situations are superimposed with a high proportion of extraneous noises, such as may be the case, for example, in a conversation with several conversation partners who do not always speak one after the other in turn, or in a dialogue in a closed room, in which other groups of people, contribute to a higher noise level due to their own conversations (so-called "cocktail party" listening situation).

To improve the speech intelligibility of the signal of an interlocutor in modern hearing aids a directional microphone algorithm is often applied, through which a narrow directional cone is directed towards the front of the user. Since in dialogues, for example, the conversation partners are usually positioned directly facing each other, i.e. for example they are seated or standing opposite one another, such a directional cone acts as a filter on the input signals of the hearing aid, which means that the speech signal of the facing conversation partner is amplified while noise signals that originate from a different direction are significantly suppressed.

Such a procedure, as is common for many and, in particular, for binaural hearing aids, may not deliver satisfactory results, however, if the user of the hearing aid is holding a conversation with several partners in a noisy environment, so that background noise from more than one speaker must be masked. To obtain a maximally intelligible signal from the particular item of conversation, the user of the hearing aid would have to always direct his head immediately towards the currently active interlocutor, because otherwise the latter's contribution to the conversation would be attenuated by the frontally-oriented directional cone. This is not really feasible in practice, however. An alternative solution would be, on identifying a more complex conversation situation of this kind, to simply widen the directional cone with which the ambient noise signals are filtered out of the input signals. However, this would also introduce an increased component of background noise into the input signals to be processed corresponding to the widening, causing the signal-to-noise ratio to deteriorate.

There can also be listening situations in which, due to the spatial arrangement of the conversation partner or partners, it is either impossible or unreasonable for the user to keep continuously orienting his viewing direction away from the frontal direction of his body towards a conversation partner in order to orientate the directional cone.

SUMMARY OF THE INVENTION

It is accordingly an object of the invention to provide a method and a hearing aid which overcome the above-mentioned and other disadvantages of the heretofore-known devices and methods of this general type and to provide for a method of operating a hearing aid, with which for a multiplicity of useful signals originating from useful signal sources that are spatially separate from one another, the best possible signal-to-noise ratio can be achieved.

With the foregoing and other objects in view there is provided, in accordance with the invention, a method of operating a hearing aid which has a first input transducer for generating a first input signal from an ambient sound signal, a second input transducer for generating a second input signal from the ambient sound signal, and an output transducer. The method comprises the following method steps:

assigning a first direction to a first useful signal source and assigning a second direction to a second useful signal source that is spatially separated from the first useful signal source;

forming, based on the first input signal and the second input signal, a first reference signal oriented in the first direction and a second reference signal oriented in the second direction;

forming an output signal by superimposing the first reference signal and the second reference signal; and converting the output signal into a sound signal by the output transducer of the hearing aid.

In other words, the above-mentioned object is achieved by a method for operating a hearing aid, which comprises at least a first input transducer, a second input transducer and at least one output transducer, wherein the first input transducer generates a first input signal from an ambient sound signal and the second input transducer generates a second input signal from the sound signal, wherein a first direction is assigned to a first useful signal source and a second direction is assigned to a second useful signal source, which is spatially separated from the first useful signal source, wherein on the basis of the first input signal and the second input signal, a first reference signal oriented in the first direction and a second reference signal oriented in the second direction are formed, wherein on the basis of the first reference signal and the second reference signal, an output signal is formed, which is converted into a sound signal by the output transducer of the hearing aid and delivered for sensory perception by the hearing aid wearer. The first reference signal and the second reference signal are superimposed to form the output signal.

Normally, the input transducer comprises an acousto-electrical transducer, which is configured to generate a corresponding electrical signal from a sound signal, for example a microphone. An output transducer generally comprises an electro-acoustic transducer, which is configured for generating a corresponding sound signal from an electrical signal, such as a loudspeaker or sound generator for bone conduction. A spatial separation of the first useful signal source from the second useful signal source in particular comprises a spatial separation within the resolution of the hearing aid. In particular, this means that the first useful signal source and the second useful signal source have different polar angles with respect to a frontal direction of the hearing aid, wherein the hearing aid is in particular configured to form two reference signals with a corresponding angular difference, thus the distance between the polar angles of the two useful signal sources can be represented by the directional signals to be aligned thereto. A reference signal in this context is to be understood as meaning a signal, which has a particularly high sensitivity for a reference sound of a reference sound source in a particular angular range, and when the reference sound source is arranged outside the given angular range, has a significantly reduced sensitivity with respect to the reference sound. In particular, the reference signal can have a maximum in its sensitivity with respect to the reference sound at a given central angle, the sensitivity with respect to the reference sound decreasing with increasing angular distance from the central angle.

The assignment of the first useful signal source to a first direction and/or of the second signal source to a second direction can be effected, in particular, on the basis of a multiplicity of reference signals. In particular, directional signals are formed from the first input signal and from the second input signal, the sensitivity maxima of which are oriented in different spatial directions. On the basis of signal components or of acoustic parameters derived therefrom in the individual reference signals, a direction will then be assigned to the first useful signal source and the second useful signal source as a first direction or as a second direction respectively, for which one of the reference signals has a sensitivity maximum. As the first reference signal, and as the second reference signal, the reference signals used for direct localization of the first useful signal source and the second signal source are then re-used, which correspond to the first direction or the second direction.

A formation of the output signal based on the first reference signal and the second reference signal is defined in particular to mean that the first reference signal and the second reference signal can be used directly as input variables into the specific signal processing for the hearing aid, wherein the output signal is taken to be the resulting signal of the signal processing specific to the hearing aid.

The formation of the output signal based on the first reference signal and based on the second reference signal allows the signal-to-noise ratio to be improved for a first useful signal generated by the first useful signal source and for a second useful signal generated by the second signal source, by virtue of noise signals, originating in particular from an angular region between the first useful signal source and the second useful signal source, being correspondingly suppressed both by the first reference signal and the second reference signal and thus having no noticeable presence in the output signal. In particular, this improves the quality of the output signal for a user of the hearing aid with regard to any ambient noise applied to the first input signal and to the second input signal, if the user is in conversation with more than one conversation partner and the conversation is accompanied by background noise. Two conversation partners are identified as a first or second useful signal source, and the first or second reference signal is oriented to one speaker, so that the voice contributions of one speaker are amplified relative to the ambient noise by the relevant reference signal. As a result of the orientation of the first reference signal and the second reference signal to one speaker in each case, the user does not need to keep track of speech activities of the conversation partner by head movements in order to be able to maintain an improvement of speech intelligibility, for example, using a fixed directional characteristic.

According to the invention it is also provided that the first reference signal and the second reference signal are superimposed to form the output signal. In particular, this means that a signal processing of the first reference signal and the second reference signal can take place which is specific to the hearing aid, and the output signal is formed from each of the resulting signals via a superposition, in particular a linear superposition, or that a superposition of the first reference signal and the second reference signal is input into the specific signal processing for the hearing aid, and the output signal is formed via the signal processing. This is also intended to comprise a superposition of the form in which a phase reconstruction is performed on the first reference signal and/or the second reference signal on the basis of the two reference signals to improve the spatial perception.

Ideally, for the superposition, linear factors are defined as a function of frequency band for the first reference signal and for the second reference signal. In particular, this means that the superposition can provide a different weighting of the first reference signal and the second reference signal in different frequency bands. This allows possible spectral differences between the first useful signal source and the second useful signal source to be taken into account so that, for example, in a frequency band in which only one of the two useful signal sources has significant signal components, the appropriate weighting of the reference signal directed to the useful signal source is higher. In particular, in the case that the first or the second useful signal source are conversational partners, it is then also possible to take account of the characteristic spectral properties of the voices of the conversation partners as well. In particular, for two or more useful signal sources, a linear superposition of the reference signals sources directed to the useful signal sources represents a particularly good simulation of the actual listening situation, in which the first useful signal and the second useful signal are also subject to a superposition and the resulting sound signal for the user must be filtered by the hearing aid to remove the background noise in order to improve the signal quality.

The first reference signal and/or the second reference signal preferably have a conical or lobe-shaped directional characteristic. Such directional characteristics can also be generated with even just two input signals using simple "sum and delay" methods.

It has proved advantageous if the directional characteristic of the first reference signal and/or the second reference signal have a maximum sensitivity at a central angle, and a sensitivity which is reduced by at least 3 dB, preferably by 5 dB at a deviation angle of 10 degrees from the respective central angle. The sensitivity is to be defined, for example, with respect to a reference signal. A directional characteristic with the described sensitivity curve can, on the one hand, be generated in hearing aids from two input signals without significant effort, and on the other hand, is nevertheless capable of extracting a useful signal of a useful signal source sufficiently well against background noise from other spatial directions.

In accordance with an advantageous feature of the invention, the first direction and the second direction are determined for the assignment on the basis of the first input signal and the second input signal. Depending on the nature of the useful signal sources and the type of listening situation, an assignment of a spatial direction to a useful signal source can also be effected, for example, via an initial setting, for example based on the assumption that a user of the hearing aid will in most cases direct his view towards one of the useful signal sources, so that the frontal direction can be specified as the initial direction. However, this is not appropriate for many listening situations. Therefore, it is advantageous to localize the first useful signal source and the second useful signal source on the basis of the first input signal and the second input signal, which are already available. The first direction and the second direction can be determined by approximation, in particular, for example in the form of a scan over a plurality of angles.

It proves to be advantageous if on the basis of the first input signal and the second input signal a multiplicity of angle-dependent directional characteristics are formed, each with a fixed central angle and a given angular spread (or, aperture), wherein the signal components for the individual directional characteristics are examined for the presence of a useful signal from a useful signal source, and wherein for a first useful signal source identified in a specific directional characteristic the corresponding central angle is defined as the first direction. This allows a particularly precise localization of the first useful signal source that is robust against background noise, since it does not use any interference-prone transit time or phase measurements, and the first direction for the first useful signal source can be specified on the basis of the existing signals—the first input signal and the second input signal—without the need for additional assumptions, —for example, frontal positioning—which may not correspond to the actual listening situation.

It is advantageous here if an angular distance between two directional characteristics that are adjacent with respect to their central angles corresponds to half the angular spread. In particular, both adjacent directional characteristics have the same angular spread. In the event that the individual directional characteristics are formed by directional cones whose sensitivity is a maximum in the direction of the central angle and decreases with increasing angular distance from the central angle, this means in particular that an angle can be specified for each individual directional characteristic, for which the sensitivity with respect to a test signal has fallen by a certain factor relative to the maximum value at the central angle, for example by 6 dB or 10 dB. Such an angle is then assigned to the corresponding directional characteristic as half the angular expansion, and the central angle of the adjacent directional characteristic is accordingly chosen at an angular distance of half the angular expansion. In the event that notch-shaped attenuations of the sensitivity curve are chosen with a minimum at the central angle for each of the individual directional characteristics, an analogous state of affairs can apply, wherein for the definition of the angular spread, instead of the attenuation of the sensitivity relative to the maximum value at the central angle, an increase in the sensitivity relative to the minimum value at the central angle is used. This allows an almost complete coverage to be achieved for a broader desirable angular range using the individual directional characteristics, while as a result of overlap of the individual directional characteristics as far as the nearest central angle, a useful signal source can always be clearly assigned to at least one of the directional characteristics, wherein due to the overlap, angular positions between two adjacent central angles are also resolvable.

In accordance with an added feature of the invention, the individual directional characteristics are each defined by a notch-shaped sensitivity characteristic, which is defined by at least two conditions, so that in each case a central angle and an angular spread of the sensitivity characteristic are specified by the at least two conditions, and wherein the signal components for the individual directional characteristics are each examined for the presence of a useful signal based on a relative attenuation due to the sensitivity characteristic.

A notch-shaped sensitivity description is to be understood as meaning a directional characteristic, which with respect to a test signal of a given loudness has the maximum attenuation of the sensitivity curve at the central angle, wherein the sensitivity increases with increasing angular distance from the central angle. The extent of this increase in the sensitivity as a function of the angular distance to the central angle then defines the angular expansion. If a useful signal source is located in the direction of a central angle of such a directional characteristic, or is in close proximity to the central angle within the angular resolution, in other words within the "notch" of the sensitivity characteristic, then the signal components of the useful signal are significantly attenuated by the directional characteristic, while components of other useful signal sources, which are located outside of the angular spread around the central angle of said directional characteristic, are largely unaffected. This can then be used to determine the presence of a useful signal source in the range of the corresponding directional characteristic.

It has also proved advantageous if the hearing aid is worn by a user wherein the first input signal and the second input signal are generated on different sides with respect to the user's head. In this case the hearing aid comprises, in particular, a binaural hearing aid. By generating the two input signals on different sides of the head of the user, the first input signal and the second input signal have different transit times with respect to incoming sound signals, where due to the width of the human head the difference can be up to half a millisecond.

Such a transit-time difference allows the first or second reference signal to be focussed on a relatively narrow angular range, which enables the signal-to-noise ratio to be improved.

In accordance with a further advantageous feature of the invention, an additional input transducer generates an additional input signal from the sound signal, wherein the first reference signal and the second reference signal are formed on the basis of the first input signal, the second input signal and the additional input signal. The use of the additional input signal in this way increases the available acoustic information, in particular the phase information, and thus enables particularly narrow reference signals to be formed as the first or second reference signal.

Ideally, an additional direction is assigned to an additional useful signal source, which is spatially separated from the first useful signal source and the second useful signal source, wherein a further reference signal oriented in the additional direction is formed on the basis of the first input signal and the second input signal, and wherein the first output signal is formed on the basis of the first reference signal, the second reference signal and the additional reference signal. In particular, the additional reference signal can also be formed on the basis of additional input signals, if more than two input signals are present. In particular, the output signal can be formed on the basis of a linear superposition of the first reference signal, the second reference signal and the additional reference signal, wherein the first reference signal, the second reference signal and the additional reference signal are preferably input into the specific signal processing for the hearing aid as a linear superposition, and the output signal is formed by the signal processing. This allows more than two useful signal sources to be handled, without any of the useful signal sources not being treated as such by the method but as background noise, in which case the useful signal would incorrectly be attenuated.

With the above and other objects in view there is also provided, in accordance with the invention, a hearing aid, in particular a binaural hearing aid, comprising at least one first microphone for generating a first input signal from an ambient sound signal, a second microphone for generating a second input signal from the sound signal, at least one first loudspeaker, and a signal processing unit, which is configured for implementing the method described above. The advantages specified for the method and for its extensions can be transferred mutatis mutandis to the hearing aid.

Other features which are considered as characteristic for the invention are set forth in the appended claims.

Although the invention is illustrated and described herein as embodied in a hearing aid and a method for operating a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Equivalent parts and variables are provided with identical reference numerals throughout the figures.

DETAILED DESCRIPTION OF THE INVENTION

Figure 1A:
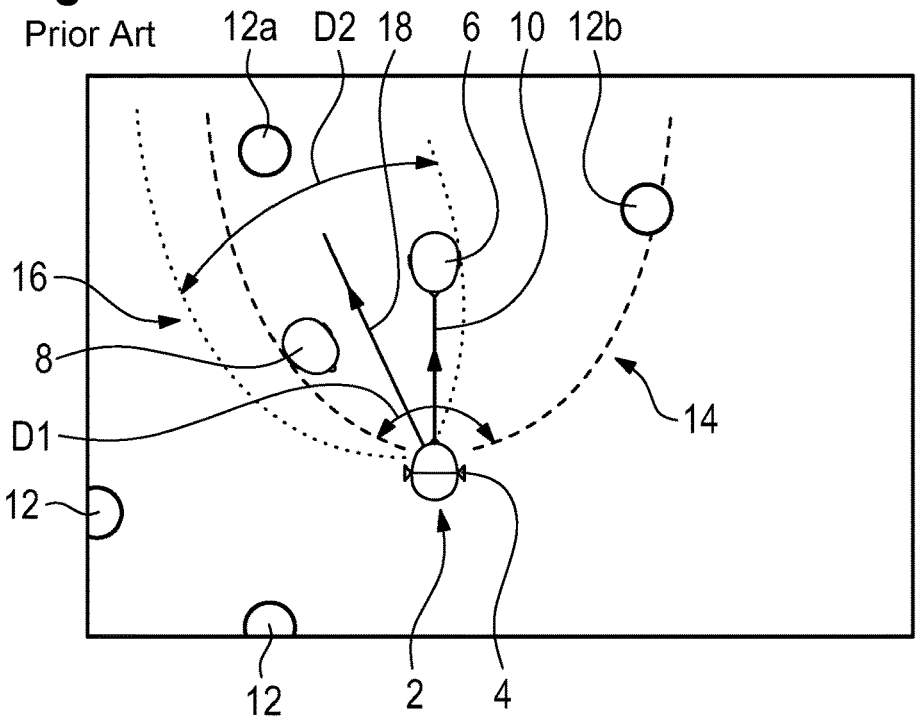
Fig. 1A Prior Art
FIG. 1A is a plan view illustrating a listening situation with two conversation partners for a user of a binaural hearing aid, and with an operation of the hearing aid according to the prior art.
Figure 1B:
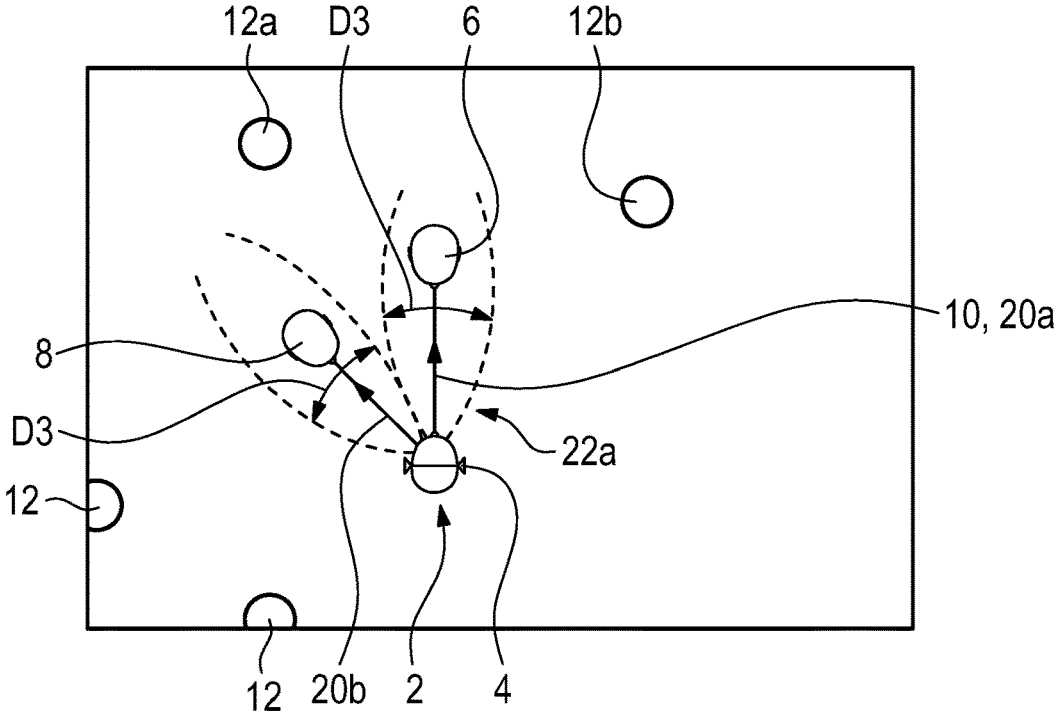
FIG. 1B is a plan view illustrating the listening situation according to FIG. 1A with an operation of the hearing aid using individual reference signals, each oriented to one conversation partner.

Referring now to the figures of the drawing in detail and first, particularly, to FIGS. 1A and 1B thereof, there is shown a plan view of a listening situation 1 of a user 2 of a hearing aid 4. The user 2 is in a conversation with a first conversation partner 6 and a second conversation partner 8. The first conversation partner 6 is seated opposite him face on, while the second conversation partner is positioned at an angle of approximately 45° with respect to the frontal direction 10 of the user 2. The listening situation 1 is such that the user's conversation 2 with the first conversation partner 6 and the second conversation partner 8 is superimposed with background noise originating from noise sources 12 distributed in the immediate vicinity. FIG. 1A then shows how, for better speech intelligibility of the contributions of the first conversation partner 6 and the second conversation partner 8, a reference signal is formed in the hearing aid 4 with a directional characteristic 14 according to the prior art. The directional characteristic 14 in this case is oriented with respect to its sensitivity maximum in the frontal direction 10 of the user 2, the angular spread D1 of the directional characteristic 14 being sufficiently large that the second conversation partner 8 is still captured by the directional characteristic 14. The large angular spread D1, however, then also causes the noise sources 12*a* and 12*b* to be captured by the directional characteristic, and accordingly the noise signals emitted by the noise sources 12*a* and 12*b* are not suppressed by the reference signal, which is formed in accordance with the directional characteristic 14, but only by the natural attenuation of the noise signals due to the greater distance from the noise sources 12*a* and 12*b* to the user 2. Such an attenuation is in many cases inadequate, however. Even the formation of an alternative directional characteristic 16, the direction of maximum sensitivity 18 of which is shifted by an angle $\alpha$ relative to the frontal direction 10 of the user 2 and is thus located between the first conversation partner 6 and the second conversation partner 8, cannot mask the noise signal emitted by the noise source 12*a* despite the smaller angular spread D2.

In contrast to this it is now proposed, as shown in FIG. 1B, to identify the first conversation partner 6 as the first useful signal source and to assign a first direction 20*a* to his position, and to identify the second conversation partner 8 as the second useful signal source and assign a second direction 20*b* to his position. In the hearing aid 4, a first reference signal is then formed with a first directional characteristic 22*a* and a second reference signal is formed with a second directional characteristic 22*b*. The first directional characteristic 22*a* and the second directional characteristic 22*b* each have the same angular spread D3, which is sufficiently small that the first or second directional characteristic 22*a*, 22*b* only captures a narrow angular range around the first or second direction 20*a*, 20*b*. This can be used to ensure that in the first reference signal, formed on the basis of the first directional characteristic 22*a*, only the conversation contributions of the first conversation partner 6 appear as significant signal components, and all noise signals of the noise sources 12, 12*a*, 12*b* are effectively suppressed. A comparable situation applies to the second reference signal formed on the basis of the second directional characteristic 22*b* with respect to the conversation contributions of the second conversation partner 8. The output signals of the hearing aid 4 audible to the user 2 are then formed as a linear superposition of the first reference signal and the second reference signal, which as a result of the spatial sensitivity of the first directional characteristic 22*a* and the second directional characteristic 22*b*, now also enables the noise signals originating from the noise source 12*a* to be suppressed.

Figure 2:
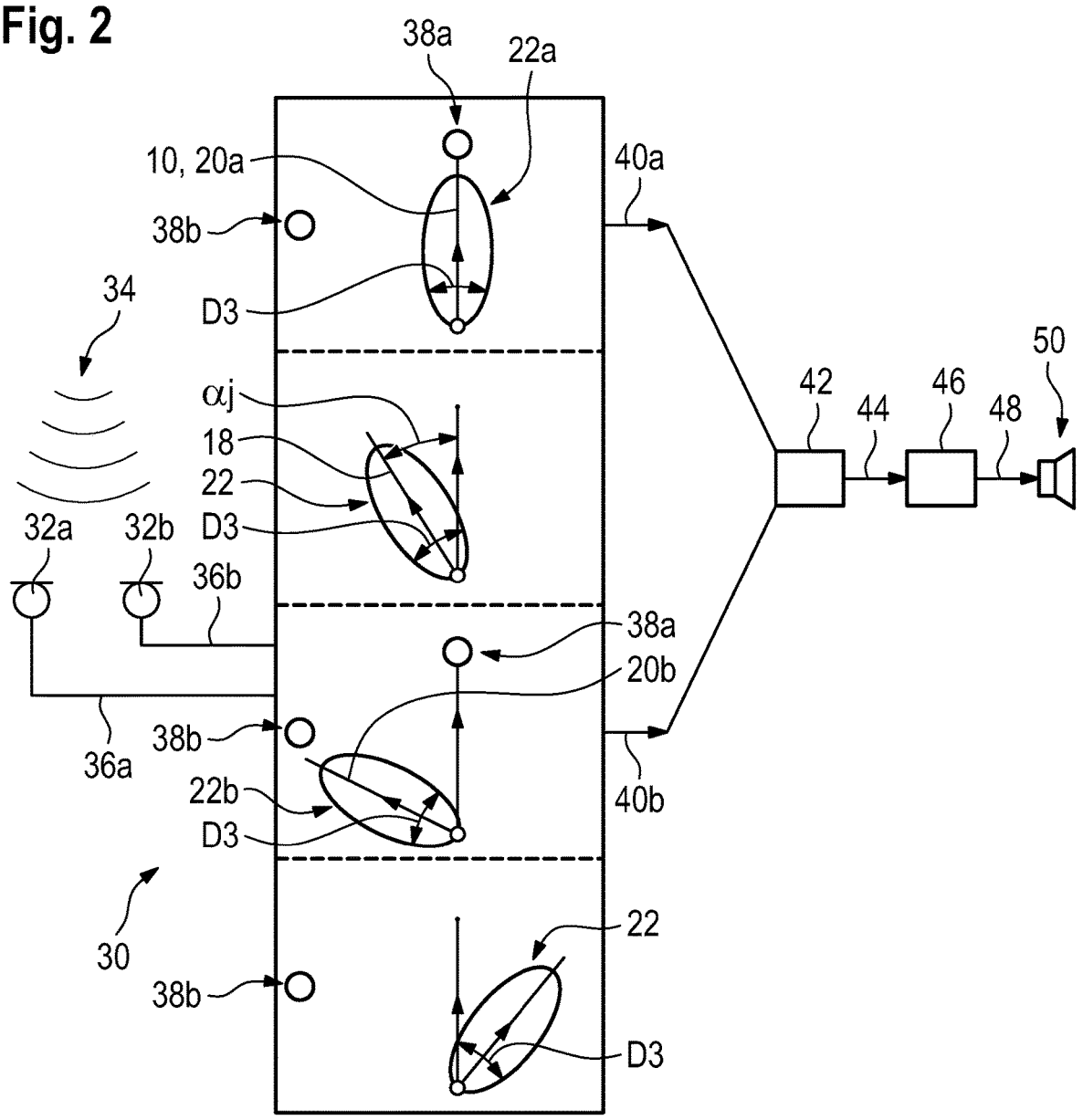
FIG. 2 a block diagram of the sequence of the method for the operation of the hearing aid in accordance with FIG. 1B.

FIG. 2 shows a block diagram of a method 30 for operating a hearing aid 4 during a listening situation 1 according to FIG. 1B. The hearing aid 4 has a first input transducer 32*a* and a second input transducer 32*b*, which are each designed as microphones. The first input transducer 32*a* or the second input transducer 32*b* generates a first input signal 36*a* or a second input signal 36*b* from an ambient sound signal 34. By means of a spatial filtering, reference signals with different directional characteristics 22 are now formed from the first or second input signal 36*a*, 36*b*. The individual directional characteristics 22 have a central angle αj with respect to the frontal direction 10 of the user 2, and an angular spread D3. The central angle αj is defined by the angle between the direction 18 of maximum sensitivity of a directional characteristic 22, and the frontal direction 10 of the user 2. Based on the reference signals with the directional characteristics 22, using the corresponding signal levels the presence of a first useful signal source 38*a* in a first direction 20*a* and the presence of a second useful signal source 38*b* in a second direction 20*b* are then determined. The first or second direction 20*a*, 20*b* is assigned to the directions 18*a*, 18*b* of maximum sensitivity of the directional characteristics 22*a*, 22*b*, the corresponding reference signals of which have the highest signal levels. The first reference signal 40*a* and the second reference signal 40*b*, which have the first directional characteristic 22*a* and the second directional characteristic 22*b* respectively, are then mixed with one another by means of a linear superposition 42, so that the resulting signal 44 from the linear superposition 42 is fed to a signal processing block 46, in which all other signal processing algorithms specific to the hearing aid 4 are implemented. The signal processing block 46 issues an output signal 48, which is converted by an output transducer 50, which in this case is formed by a loudspeaker, into an audible sound signal for the user 2.

Figure 3:
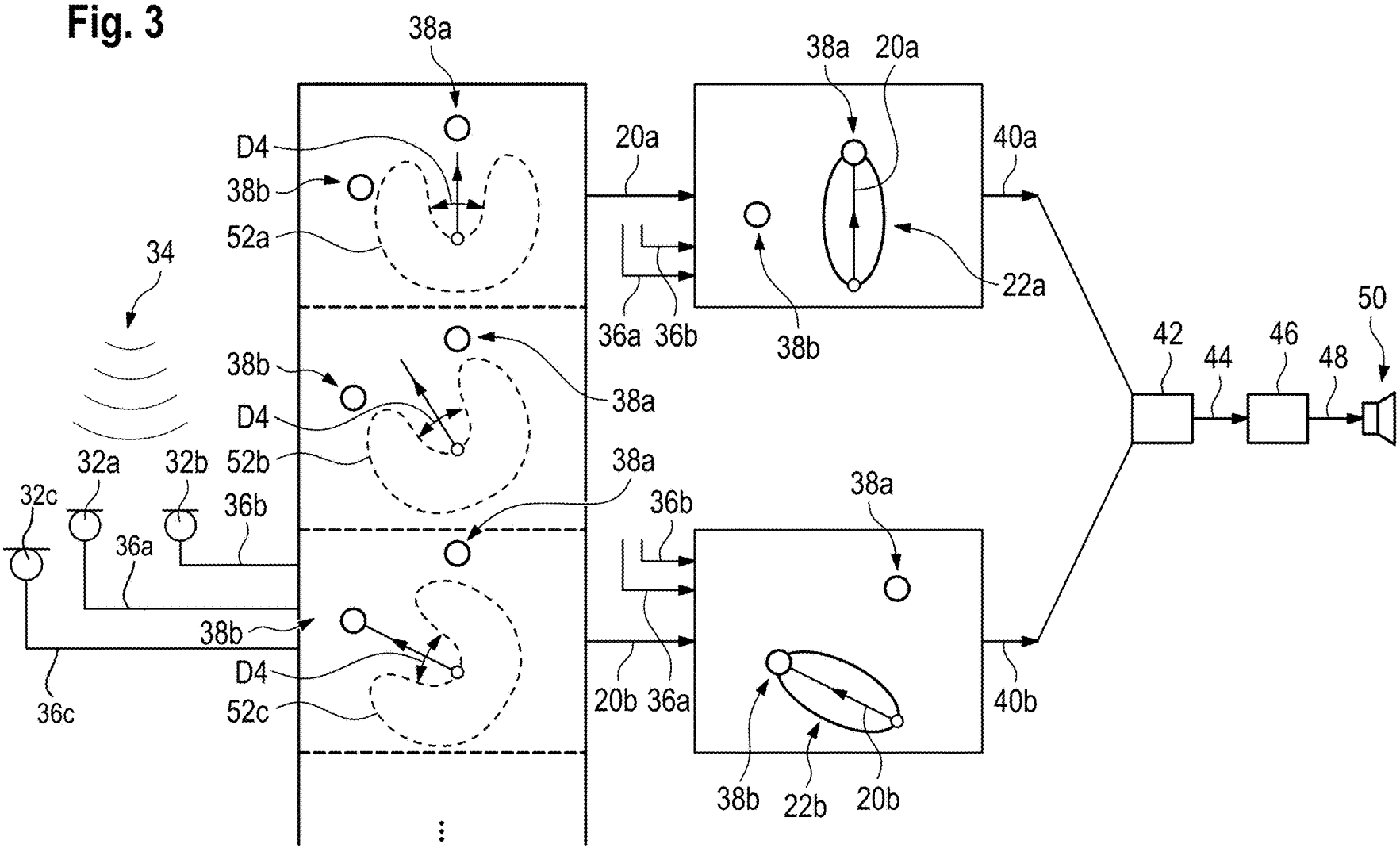
FIG. 3 a block diagram of an alternative sequence of the method in accordance with FIG. 2 for the operation of the hearing aid in accordance with FIG. 1B.

FIG. 3 shows a schematic block diagram illustrating an alternative sequence of the method 30 according to FIG. 2. Via the first or second input signal 36*a*, 36*b*, a multiplicity of notch-shaped sensitivity characteristics 52*a* to 52*d* is now superimposed, each of which has the same angular spread D4 and a sensitivity minimum at a central angle αj. The positions of the first and second useful signal source 38*a*, 38*b* are then defined based on the identification of the reference signals for which the relative signal level, normalized by the total signal level, is reduced the most by the corresponding sensitivity characteristic 52*a* to 52*d*. The two central angles αj of the relevant sensitivity characteristics 52*a*, 52*b* are then assigned to the first or second signal source 38*a*, 38*b* as the first and second direction 20*a*, 20*b* respectively. Thereafter, from the first and second input signal 36*a*, 36*b*, the first reference signal 40*a* and the second reference signal 40*b* are formed, which have the first and second directional characteristic 22*a*, 22*b* respectively. The subsequent steps of linear superposition 42 of the first and second reference signal 40*a*, 40*b* are identical to the embodiments of the method 30 shown in FIG. 2.

An additional input transducer 32 *c* may be provided to generate an additional input signal 36 *c* from the sound signal 34. In this case, the first reference signal 40 *a* and the second reference signal 40 *b* can be formed on the basis of the first input signal 36 *a*, the second input signal 36 *b* and the additional input signal 36 *c*. The use of the additional input signal 36 *c* in this way increases the available acoustic information, in particular the phase information, and thus enables particularly narrow reference signals to be formed as the first reference signal 40 *a* or the second reference signal 40 *b*.

Although the invention has been illustrated and described in detail using the preferred exemplary embodiment, the invention is not limited by this exemplary embodiment. Other variations can be derived from this by the person skilled in the art without departing from the scope of protection of the invention.

The following is a summary list of reference numerals and the corresponding structure used in the above description of the invention:

1 listening situation
2 user
4 hearing Aid
6 first conversation partner
8 second conversation partner
10 frontal direction
12 noise source
12*a* noise source
12*b* noise source
14 directional characteristic
16 directional characteristic
18 direction of maximum sensitivity
20*a* first direction
20*b* second direction
22 directional characteristic
22*a* first directional characteristic
22*b* second directional characteristic
30 method
32*a* first input transducer
32*b* second input transducer
34 sound signal
36*a* first input signal
36*b* second input signal
38*a* first useful signal source
38*b* second useful signal source
40*a* first reference signal
40*b* second reference signal
42 superposition
44 resulting signal
46 signal processing block
48 output signal
50 output transducer
52*a-d* sensitivity characteristic
D1-D4 angular spread (aperture)
α angle (amplitude)
αj central angle

The invention claimed is:

1. A method of operating a hearing aid having a first input transducer for generating a first input signal from an ambient sound signal, a second input transducer for generating a second input signal from the ambient sound signal, and an output transducer, the method which comprises:

assigning a first direction to a first useful signal source and assigning a second direction to a second useful signal source that is spatially separated from the first useful signal source;

forming, based on the first input signal and the second input signal, a first reference signal oriented in the first direction and a second reference signal oriented in the second direction;

forming an output signal by superimposing the first reference signal and the second reference signal; and converting the output signal into a sound signal by the output transducer of the hearing aid.

2. The method according to claim 1, which comprises, for superimposing the first and second reference signals, defining linear factors as a function of frequency band for the first reference signal and for the second reference signal.

3. The method according to claim 1, wherein one or both of the first and second reference signals have a conical or lobe-shaped directional characteristic.

4. The method according to claim 3, wherein the directional characteristic of the first reference signal and/or of the second reference signal has a maximum sensitivity at a central angle and a sensitivity which is attenuated by at least 3 dB at an angle of deviation of 10° from the respective central angle.

5. The method according to claim 1, wherein the assigning step comprises determining the first direction and the second direction on a basis of the first input signal and of the second input signal.

6. The method according to claim 5, wherein:

based on the first input signal and the second input signal, a multiplicity of angle-dependent directional characteristics is formed, in each case having a fixed central angle and a given angular spread;

examining signal components for the individual directional characteristics for a presence of a useful signal from a useful signal source; and for a first useful signal source identified in a specific directional characteristic, specifying a corresponding central angle as the first direction.

7. The method according to claim 6, wherein an angular distance between two adjacent directional characteristics with respect to their respective central angles corresponds to half the given angular spread.

8. The method according to claim 6, which comprises:

defining each of the individual directional characteristics by a notch-shaped sensitivity characteristic, which is defined by at least two conditions, so that in each case the central angle and the angular spread of the sensitivity characteristic are specified by the at least two conditions; and examining each of the signal components for the individual directional characteristics for the presence of the useful signal based on a relative attenuation due to the sensitivity characteristic.

9. The method according to claim 1, wherein:

the hearing aid is worn by a user; and the first input signal and the second input signal are generated on different sides with respect to the head of the user.

10. The method according to claim 1, wherein a further input transducer generates a further input signal from the ambient sound signal, and the forming step comprises forming the first and second reference signals based on the first input signal, the second input signal and the further input signal.

11. The method according to claim 1, which comprises:

assigning a further direction to a further useful signal source that is spatially separated from the first useful signal source and the second useful signal source;

forming a further reference signal oriented in the further direction based on the first input signal and the second input signal; and forming the output signal based on the first reference signal, the second reference signal and the further reference signal.

12. A hearing aid, comprising:

at least one first input transducer for generating a first input signal from an ambient sound signal;

a second input transducer for generating a second input signal from the ambient sound signal;

at least one output transducer; and a signal processing unit configured for carrying out the method according to claim 1.

* * * * *